US008366458B2

(12) United States Patent
Ngo et al.

(10) Patent No.: US 8,366,458 B2
(45) Date of Patent: Feb. 5, 2013

(54) ELECTRICAL POWER CONNECTOR SYSTEM

(75) Inventors: Hung Viet Ngo, Harrisburg, PA (US); Steven E. Minich, York, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 12/818,722

(22) Filed: Jun. 18, 2010

(65) Prior Publication Data

US 2010/0330846 A1 Dec. 30, 2010

Related U.S. Application Data

(60) Provisional application No. 61/220,156, filed on Jun. 24, 2009.

(51) Int. Cl.
*H01R 12/00* (2006.01)

(52) U.S. Cl. ..... 439/79; 439/908

(58) Field of Classification Search ..... 439/79, 439/907, 908, 721, 723, 509–513, 781, 782, 439/790, 791, 796–798
See application file for complete search history.

(56) References Cited

U.S. PATENT DOCUMENTS

| | | | | |
|---|---|---|---|---|
| 3,284,754 | A * | 11/1966 | Buchanan | 439/436 |
| 5,004,438 | A * | 4/1991 | Cabourne | 439/825 |
| 5,630,720 | A | 5/1997 | Kocher | |
| 5,810,617 | A * | 9/1998 | Hasagawa | 439/510 |
| 6,471,523 | B1 * | 10/2002 | Shuey | 439/63 |
| 6,814,590 | B2 | 11/2004 | Minich et al. | |
| 7,331,830 | B2 | 2/2008 | Minich | |
| 7,811,100 | B2 | 10/2010 | Stoner | |
| 2005/0037655 | A1 | 2/2005 | Henry et al. | |
| 2006/0194472 | A1 * | 8/2006 | Minich et al. | 439/552 |
| 2007/0207541 | A1 | 9/2007 | Oksman | |

* cited by examiner

*Primary Examiner* — Ross Gushi
(74) *Attorney, Agent, or Firm* — Woodcock Washburn LLP

(57) ABSTRACT

An electrical power connector comprises a housing having a mounting interface and a mating interface. The mating interface defines a plurality of receptacles spaced apart in more than one direction. A plurality of electrical contacts is supported by the housing. These electrical contacts define respective mounting ends that are configured to electrically connect with an electrical component at the mounting interface, and opposed mating ends. At least one of the electrical contacts defines a common contact beam disposed within at least a select one of the receptacles. This common contact beam is configured to be electrically connected to a pair of adjacent electrical contacts of a mated electrical connector.

19 Claims, 15 Drawing Sheets

ELECTRICAL POWER CONNECTOR SYSTEM

CROSS-REFERENCE TO RELATED APPLICATIONS

This application claims the benefit of U.S. provisional patent application Ser. No. 61/220,156 filed on Jun. 24, 2009, the disclosure of which is hereby incorporated by reference as if set forth in its entirety herein.

BACKGROUND

Electrical connectors conventionally include a housing that retains a plurality of electrical contacts that define opposing mating ends and mounting ends. The electrical contacts can be supported in a connector housing, such that the electrical contacts extend along a length between a mounting end and an opposing mating end. The mating ends of the electrical contacts define a mating interface for the electrical connector, while the mounting ends of the electrical contacts define a mounting interface for the electrical connector. The mounting ends may be configured to connect to an external electrical component, which can be provided as an underlying substrate or printed circuit board (PCB), while the mating ends may be configured to connect to the mating ends of another electrical connector.

For example, when electrically connecting a pair of electrical components, the mounting ends of the electrical contacts of one or more electrical connectors can be press fit, surface mounted, or otherwise electrically connected to one of the electrical components, while the mounting ends of the electrical contacts of one or more other electrical connectors can be press fit, surface mounted, or otherwise electrically connected to the other electrical component. The electrical connectors are then mated together to establish an electrical connection between the electrical components. The mating ends can be provided as receptacle or header ends, whereby receptacle mating ends receive header mating ends, or can be gender-neutral. Electrical connectors are generally provided as vertical or mezzanine connectors whereby the mating ends and mounting ends extend parallel to each other or as right-angle connectors whereby the mating ends and the mounting ends extend perpendicular to each other.

When the electrical components are provided as printed circuit boards, the electrical connectors are press-fit, surface mounted, or otherwise placed in electrical communication with electrical traces running through or along the corresponding board. In one application, electrical connectors are mounted along a pair of printed circuit boards. For instance, a first plurality of electrical connectors is mounted along the edge of one printed circuit board, while a second plurality of electrical connectors is mounted along a second circuit board. The electrical connectors are then mated at their mating interfaces, so as to electrically connect the mating ends of the first and second pluralities of electrical contacts.

What is desired is an electrical connector having a reduced footprint so as to correspondingly reduce the real estate occupied by the connected on the circuit board.

SUMMARY

In accordance with one embodiment, an electrical power connector comprises a housing having a mounting interface and a mating interface. The mating interface defines a plurality of receptacles spaced apart in more than one direction. A plurality of electrical contacts is supported by the housing.

These electrical contacts define respective mounting ends that are configured to electrically connect with an electrical component at the mounting interface, and opposed mating ends. At least one of the electrical contacts defines a common contact beam disposed within at least a select one of the receptacles. This common contact beam is configured to be electrically connected to a pair of adjacent electrical contacts of a mated electrical connector.

In accordance with another embodiment, an electrical power connector system comprises a first electrical connector including a first connector housing. The first connector housing supports a first electrical power contact and a second electrical power contact that is disposed adjacent the first electrical power contact. The electrical power connector system further comprises a second electrical connector that includes a second connector housing. The second connector housing defines a plurality of receptacles and supports a plurality of electrical contacts. A common contact beam of one of the plurality of electrical contacts is operatively associated with at least a select one of the plurality of receptacles. The common contact beam is configured to electrically couple to both of the first and second electrical power contacts of the first electrical connector when the first electrical connector is mated with the second electrical connector.

In accordance with yet another embodiment, an electrical power receptacle connector is configured to mate with a header connector. The header connector comprises a header connector housing and first and second adjacent header contacts that are supported by the housing. Each header contact defines at least a pair of first and second fingers. The electrical power receptacle connector comprises a housing supporting a plurality of electrical contacts that are spaced apart along a row direction. The housing defines at least a pair of receptacles spaced along a column direction that is orthogonal to the row direction. The electrical contacts define a common contact beam in each of the pair of receptacles. First and second dedicated contact beams are disposed on opposing sides of the common contact beam in each of the pair of receptacles. In this way, the respective first and common contact beams define a first chamber configured to electrically connect to the first and second fingers, respectively, of the first header contact. The respective second and common contact beams define a second chamber configured to electrically connect to the first and second fingers, respectively, of the second header contact.

BRIEF DESCRIPTION OF THE DRAWINGS

The foregoing summary, as well as the following detailed description of a preferred embodiment, are better understood when read in conjunction with the appended diagrammatic drawings. The drawings show an embodiment that is presently preferred. Thus, the invention is not limited to the specific instrumentalities disclosed in the drawings. In the drawings.

DETAILED DESCRIPTION

Figure 1:
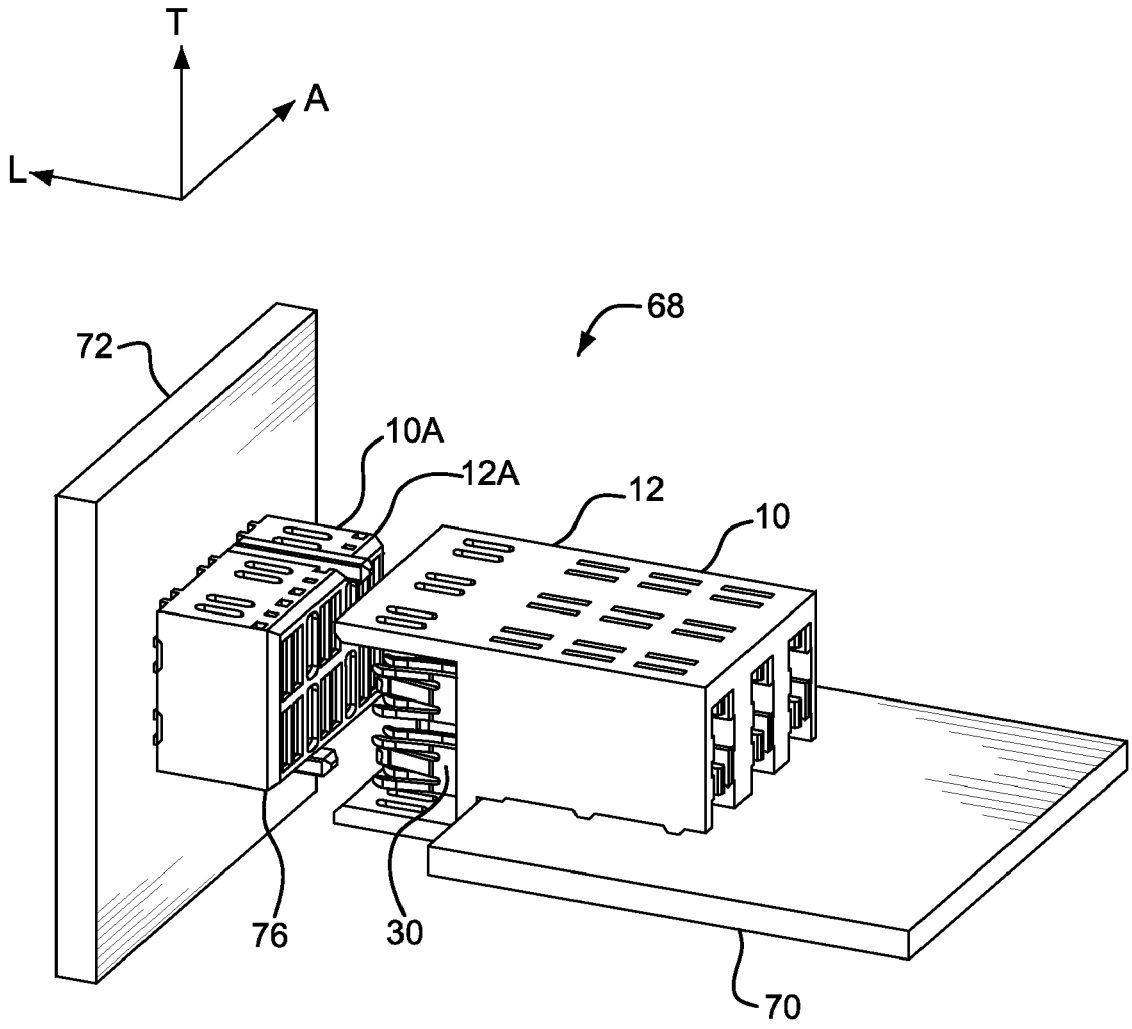
FIG. 1 is a perspective view of an electrical connector system including an electrical header connector and an electrical receptacle connector constructed in accordance with one embodiment.
Figure 2:
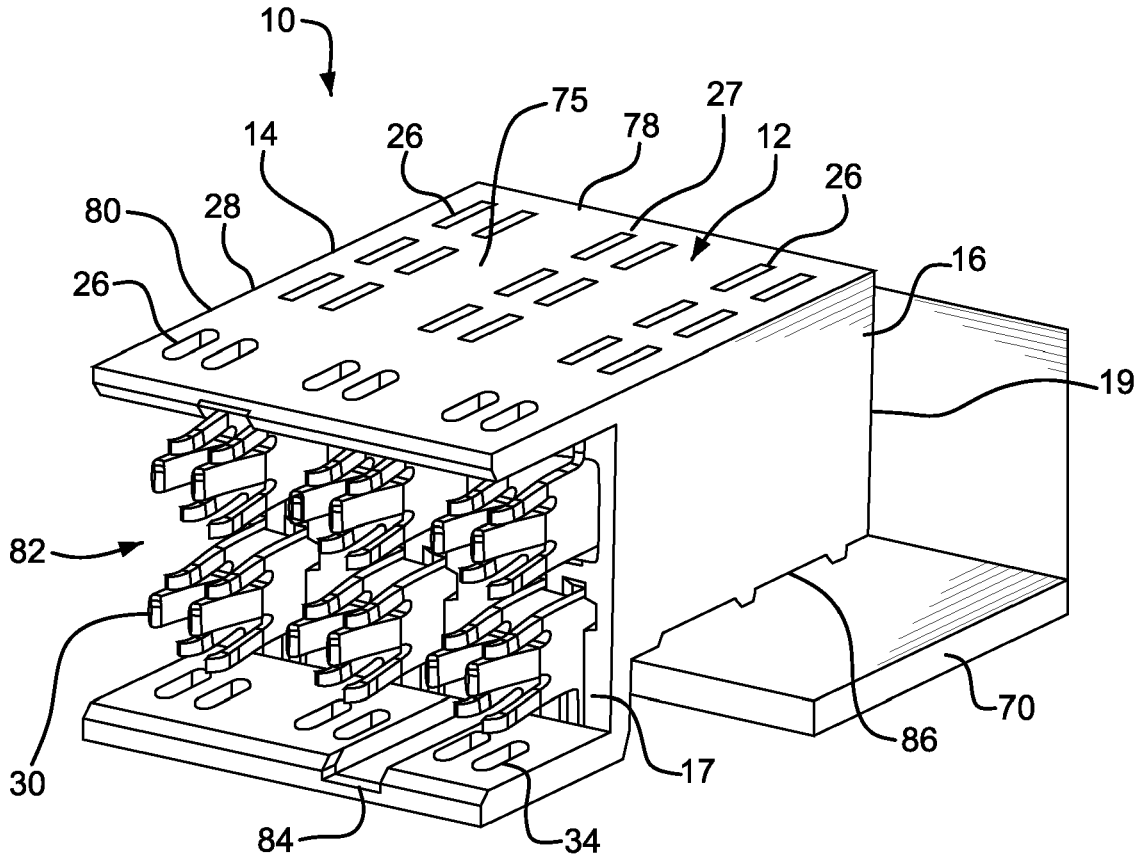
FIG. 2 is a top perspective view of the electrical header connector.
Figure 3:
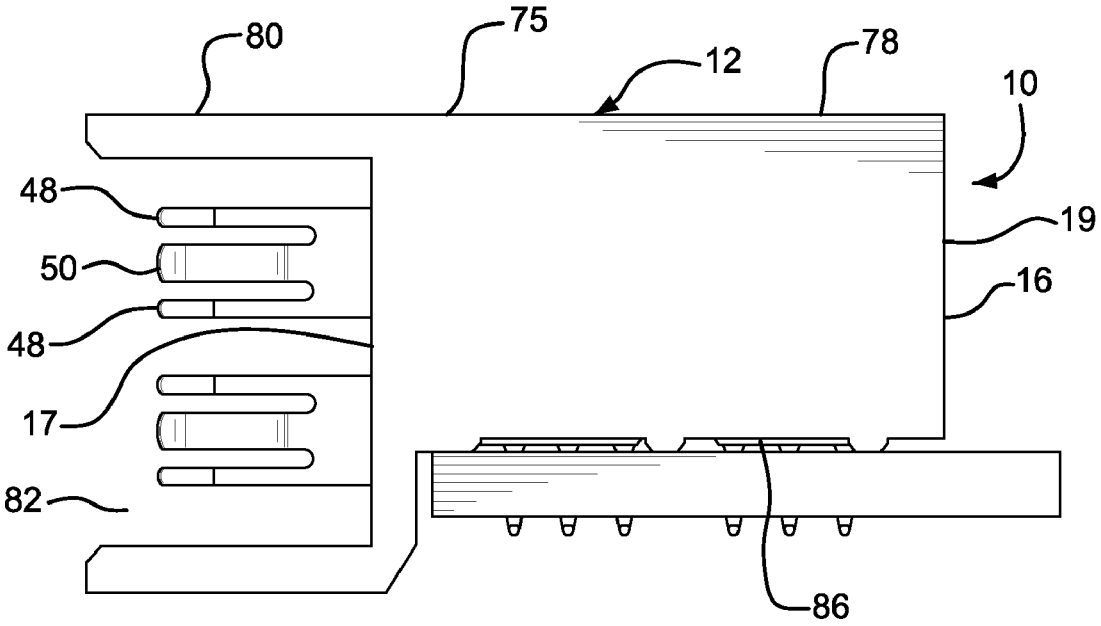
FIG. 3 is a side elevation view of the electrical header connector illustrated in FIG. 2.
Figure 4:
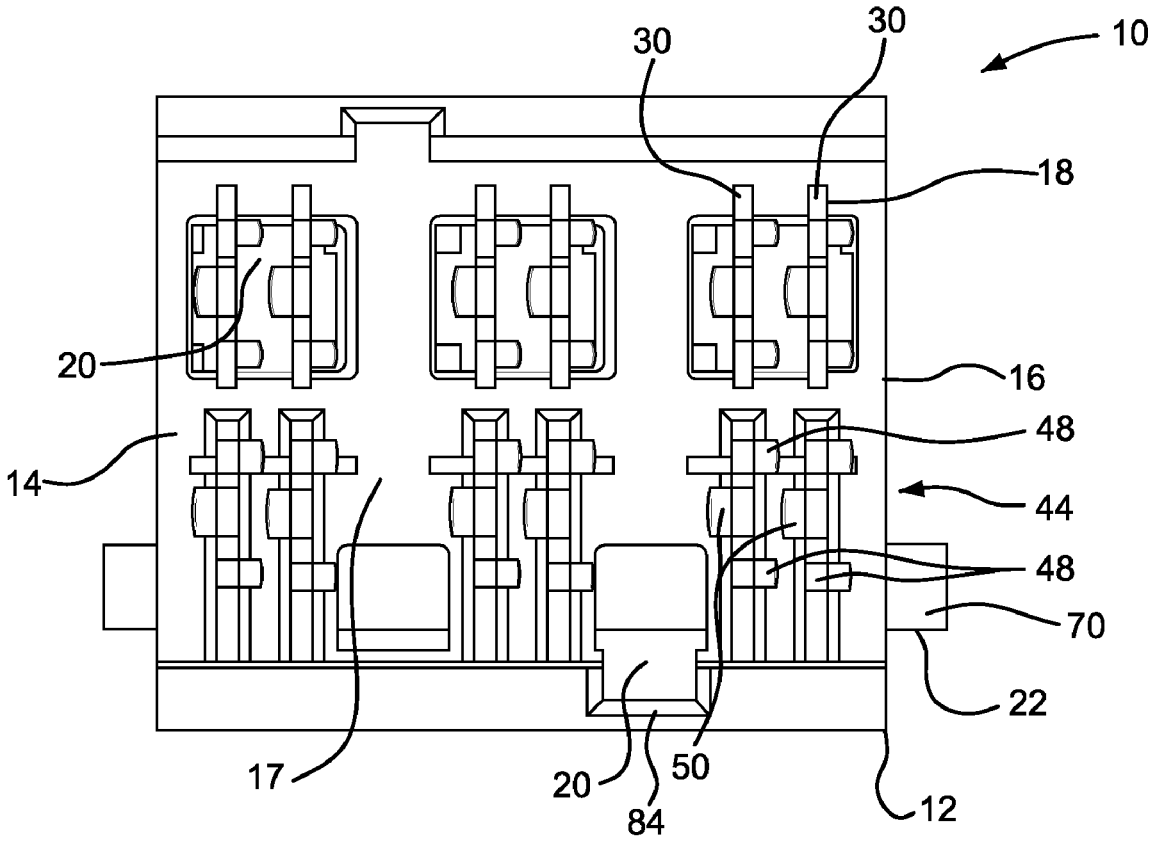
FIG. 4 is a front elevation view of the electrical header connector illustrated in FIGS. 2 and 3.
Figure 5:
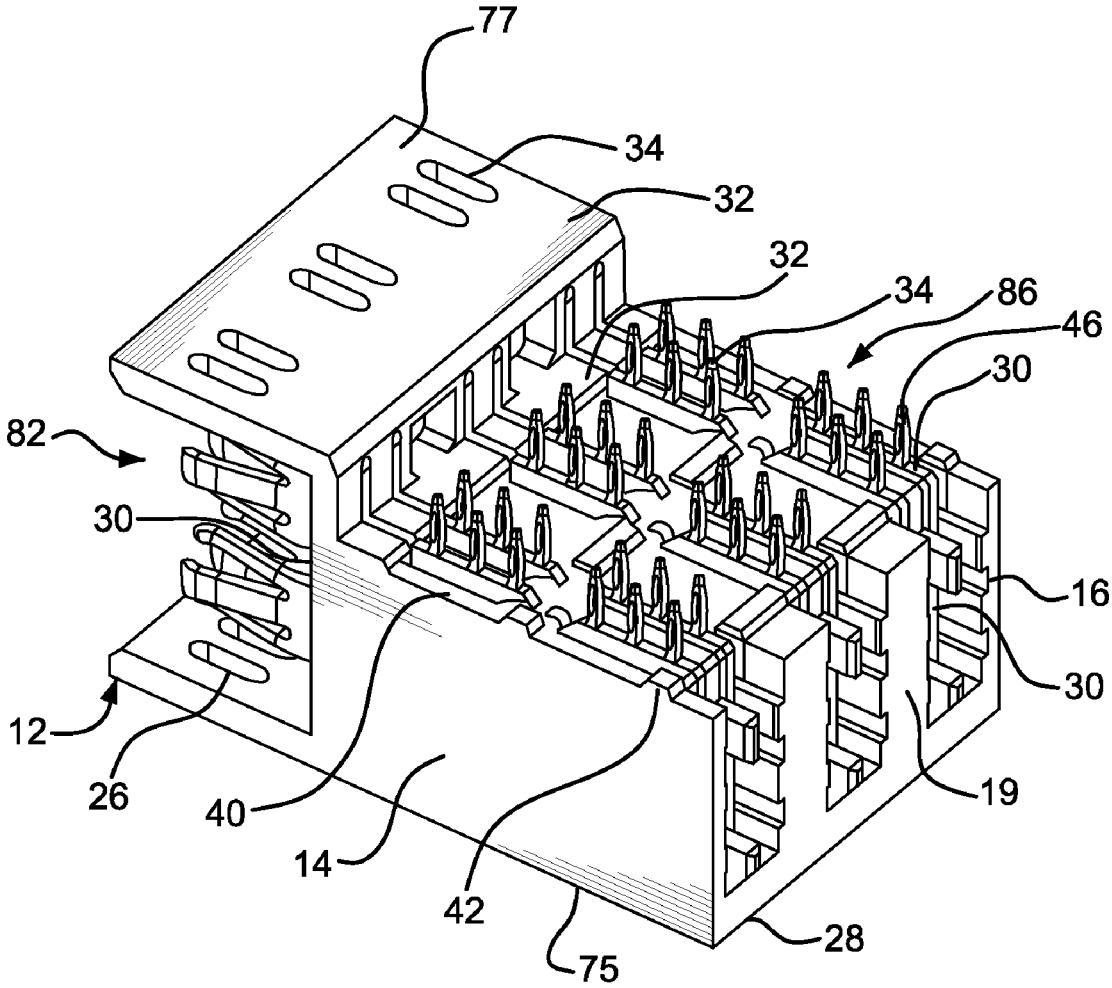
FIG. 5 is a bottom perspective view of the electrical connector illustrated in FIGS. 2-4.

Referring to FIG. 1, an electrical connector system 68 is configured to removably connect a first electrical component or substrate 70 such as a printed circuit board (PCB) illustrated as a daughter card, to a second electrical component or substrate 72 such as a PCB illustrated as a back panel or mother board 72. It should be appreciated that the first and second electrical components could alternative comprise any suitable electrical component as desired. Although the electrical connector system 68 and its components are described with reference to exemplary embodiments shown in the drawings, it should be understood that the electrical connector system 68 and its components can be embodied in many alternative forms of embodiments. In addition, any suitable size, shape, or type of elements or materials could be used.

In one embodiment, the electrical connector system 68 provides a high power connector system for power-to-daughter card applications. For example, the system 68 can be used to supply 150 Volts or more. It has been found that implementation of the connector system 68 can meet the specifications for UL 60950, IEC 61984, and IEC 664-1 for a 150-160 Volt secondary circuit power card-to-back panel connection.

Figure 9:
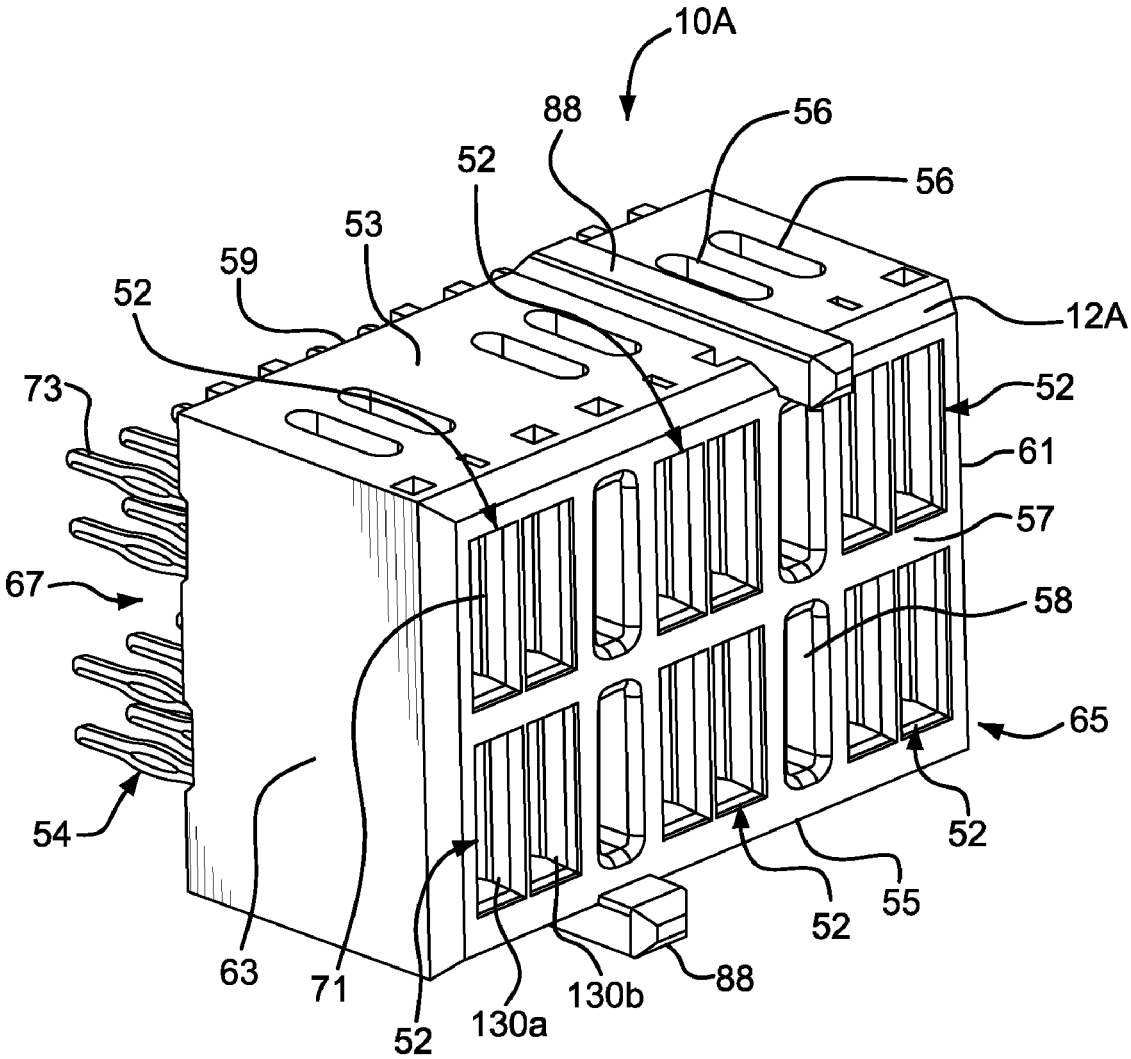
FIG. 9 is top perspective view of the electrical receptacle connector illustrated in FIG. 8.
Figure 10A:
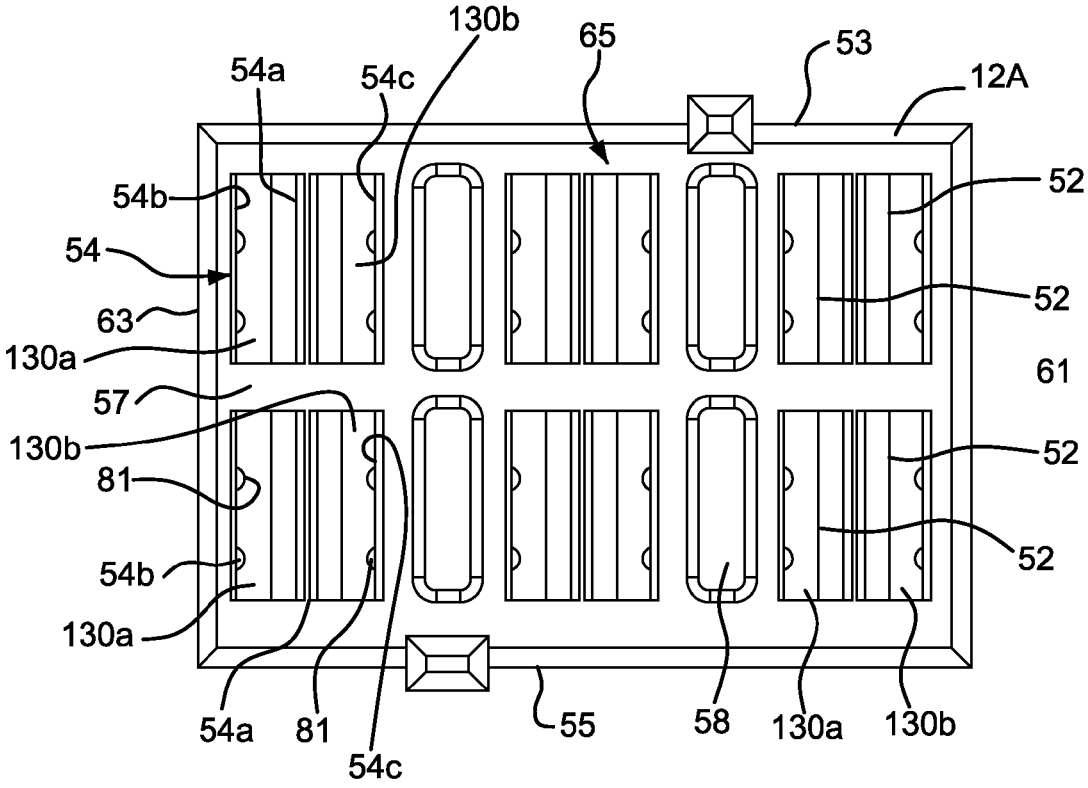
FIG. 10A is a front elevation view of the electrical receptacle connector illustrated in FIG. 8.
Figure 10B:
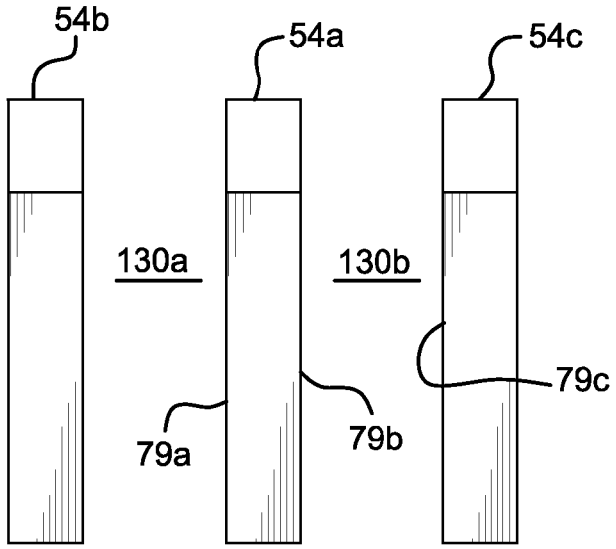
FIG. 10B is a front elevation view of the electrical contacts as arranged within the electrical connector illustrated in FIG. 10A.
Figure 11:
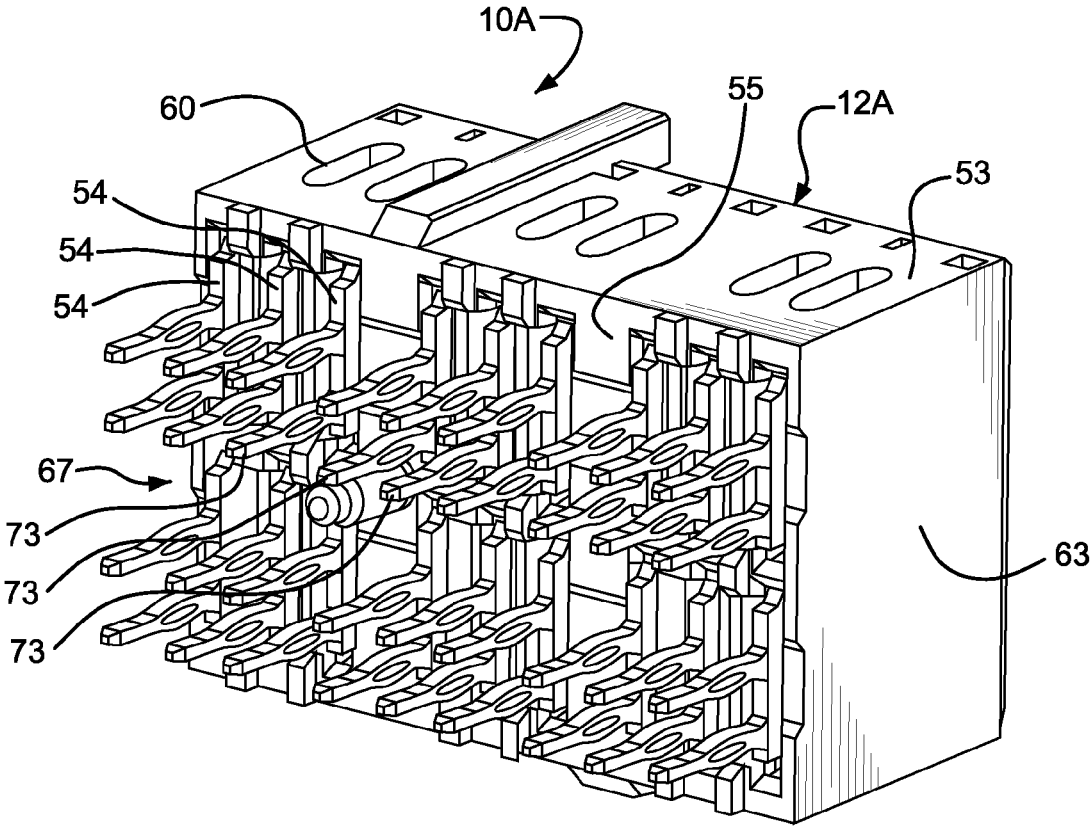
FIG. 11 is a bottom perspective view of the electrical receptacle connector illustrated in FIG. 8.

The electrical connector system 68 generally includes a first electrical header connector 10 and a second electrical receptacle connector 10A. The first electrical connector 10 includes a dielectric or electrically insulative housing 12 that retains a plurality of electrical header contacts 30. Likewise, the second electrical connector 10A includes a dielectric or electrically insulative housing 12A that retains a plurality of electrical receptacle power contacts 54 (see FIG. 9). The insulative housings 12 and 12A can be made from any suitable molded plastic or polymer material.

The header connector 10 is shown mounted to the first electrical component 70, while the receptacle connector 10A is shown mounted to the second electrical component 72, though it should be appreciated that the connectors 10 and 10A can alternatively be connected to any electrical component as desired. The first electrical connector 10 in FIG. 1 is shown unmated with second electrical connector 10A, though the connectors 10 and 10A can be mated as described below, so as to place the first and second electrical components 70 and 72 in electrical communication.

Referring now to FIGS. 2-5, the first electrical connector housing 12 generally defines a front section 80 and an opposed rear section 78 separated from the front section 80 along a longitudinal direction L. The front section 80 defines a mating interface 82 configured to interface with the complementary receptacle connector 10A, and the rear section 78 defines a mounting interface 86 configured to interface with the first electrical component or substrate 70. The housing 12 further includes a top wall 75, a vertical divider wall or front wall 17 and a longitudinally opposed vertical rear wall 19, and side walls 14 and 16 that are opposed along a lateral direction A. The divider wall 17 separates the front section 80 and the rear section 78. The housing 12 further defines a bottom wall 77 that is opposed to the top wall 75 along a transverse direction T, and extends forward from the divider wall 17 and vertically spaced from the top wall 75 so as to define the mating interface 82. It should be appreciated that the mating interface 82 could alternatively be constructed as desired so as to mate with a complementary electrical connector.

The housing 12 defines a first plurality of heat dissipation slots 26 extending transversely through the top wall 75. The heat dissipation slots 26 are arranged in parallel rows 27 that extend along a longitudinal direction L. The rows 27 extend along a lateral direction A that extends substantially perpendicular to the longitudinal direction L and the transverse direction T. The housing 12 can further includes a second plurality of heat dissipation slots 34 that extend transversely through the bottom wall 77 of the housing 12, and can further be disposed at the mounting end 86 of the housing. One or more, up to all, of the heat dissipation slots 34 can be aligned with the heat dissipation slots 26, so as to permit heat generated during operation of the connector 10 to escape the housing 12 via the slots 26 and 34. The housing 12 further includes a plurality of contact reception slots 18 that extend in the divider wall 17 and are configured to support corresponding electrical contacts 30, such that mating ends of the electrical contacts extend forward of the divider wall 17 and into the mating interface 82. The connector can further define at least one such as a plurality of heat dissipation cutouts 40 extending into the mounting interface 86 of the housing 12, and at least one such as a plurality of standoffs 42 extending down from the mounting interface 86 of the housing 12. The cutouts 40 and standoffs 42 allow heat generated during operation at the mounting interface 86 to escape the housing 12 via the cutouts 40 and the standoffs 42.

Because the mating interface 82 is oriented substantially perpendicular with respect to the mounting interface 86, the electrical connector 10 can be referred to as a right-angle connector, though it should be appreciated that the electrical connector 10 could alternatively be constructed as a vertical or mezzanine connector as desired, whereby the mating interface 82 extends substantially parallel to the mounting interface 86.

Referring now to FIGS. 2-6, the electrical connector 10 includes a plurality of electrical contacts 30 supported or retained by the insulative housing 12. In particular, the housing 12 defines a plurality of contact reception slots 18 that extend into or through the divider wall 17, such that the contacts 30 extend through the divider wall 17, and are supported in the contact reception slots 18. In accordance with the illustrated embodiment, the contact reception slots 18 are arranged in laterally spaced pairs, each receiving a corresponding electrical contact 30, such that the electrical contacts are arranged in laterally spaced pairs, such that contacts within a given pair are spaced closer together than the contacts of a different pair. Furthermore, as is described in more detail below, each pair of electrical contacts 30 is configured to be received in a common or shared receptacle of the complementary receptacle connector 10A.

Figure 6A:
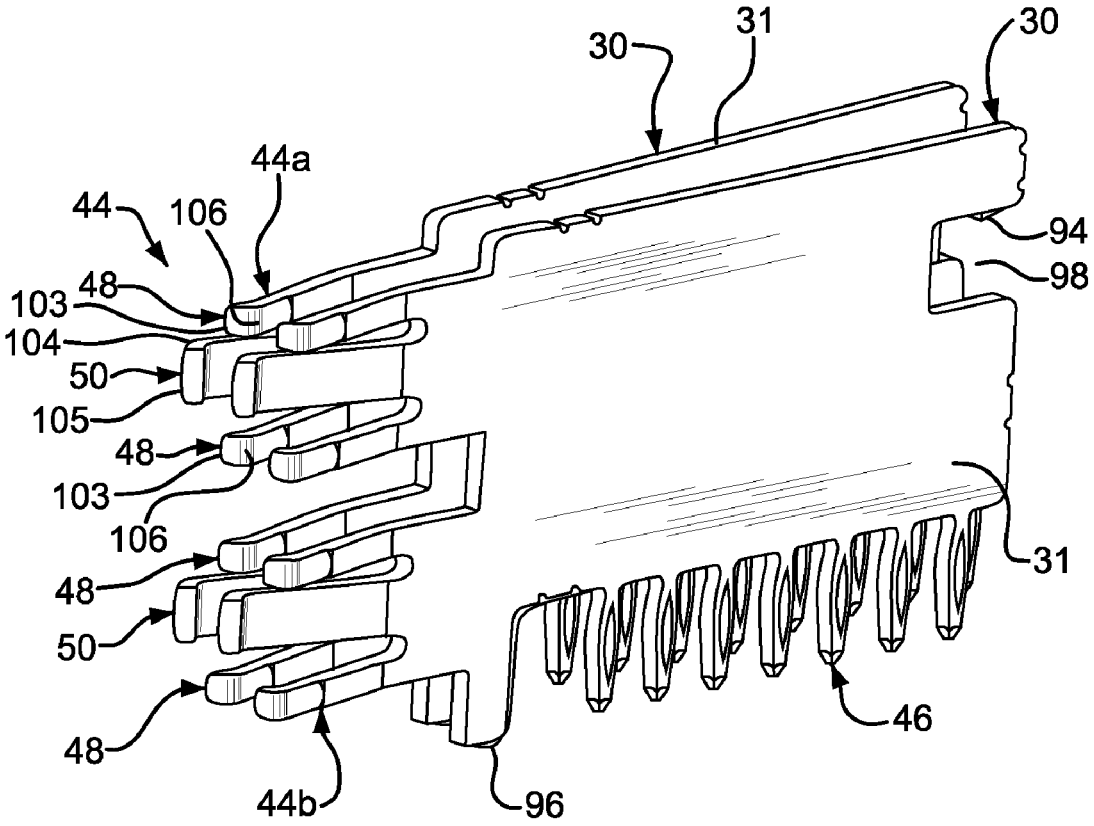
FIG. 6A is a perspective view of a pair of electrical power contacts of the electrical header connector illustrated in FIG. 2 in accordance with one embodiment.
Figure 6B:
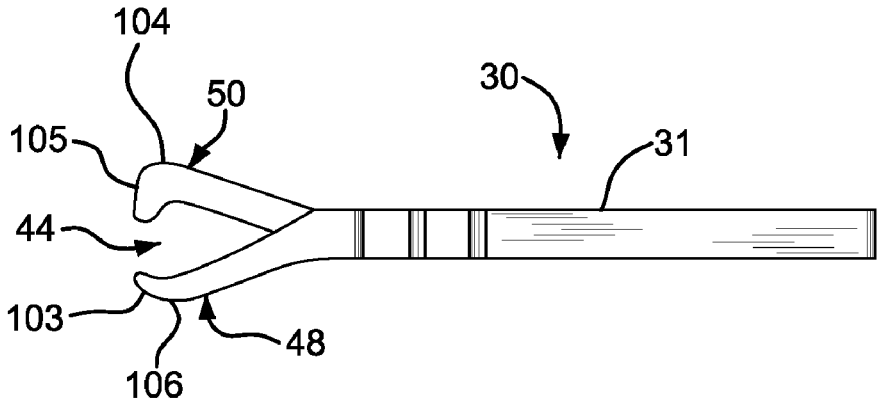
FIG. 6B is a top plan view of one of the electrical power contacts illustrated in FIG. 6A.

As best shown in FIGS. 6A-B, each electrical contact 30 includes a contact body 31, a mating end 44 that projects forward from the contact body 31, and an opposed mounting end 46 extending down from the contact body 31. The mating end 44 is configured to connect to a mating end of a complementary electrical contact of the electrical connector 10A, and the mounting end is configured to connect to electrical traces running through the substrate or PCB 70. Because the mating end 44 is oriented substantially perpendicular with respect to the mounting end 46, the electrical contact 30 can be referred to as a right-angle contact, though it should be appreciated that the contact 30 could alternatively be constructed as a vertical or mezzanine contact as desired, whereby the mating end 44 extends substantially parallel to the mounting end 46.

Each power contact 30 of the electrical connector 10 can be constructed substantially identically to each other. The connector 10 is illustrated as including six power contacts 30 arranged in three pairs, corresponding spatially to the pairs of contact reception slots 18, though it should be appreciated that the electrical connector 10 can include one or more power contacts 30 as desired.

The power contacts 30 are illustrated as including a one-piece metal member which has been stamped and subsequently plated, at least at some of its contact surfaces. The power contacts 30 are substantially flat or planar except at the mating end 44. Otherwise stated, the power contact 30 has a planar portion and a non-planar portion, the non-planar portion being disposed at the mating end 44. The mounting ends 46 are illustrated as including a plurality of through-hole press-fit contact tails, though it should be appreciated that the mounting ends 46 can alternatively be provided in alternative forms, including surface mounts, solder tails, and the like.

In accordance with one embodiment, the power contact can be made from a highly conductive high-performance copper alloy material. Some high performance copper alloy materials are highly conductive material. One example of a highly conductive high-performance copper alloy material is sold under the descriptor C18080 by Olin Corporation, having a place of business in Clayton, Mo. However, in alternate embodiments, other types of materials could be used. A highly conductive high-performance copper alloy material may have a minimum bend radius to material thickness ratio (R/T) of greater than one; whereas common conventional metal conductors may have a R/T of less than one-half.

The power contacts 30 can include a first retention member 94 that is illustrated as a recess extending into the rear of the contact body 31, and a second retention member 96 extending down from a bottom side of the front end of the contact body 31, at a location proximate to the mating end 42. The retention members 94 and 96 are configured to engage with the housing 12 to fixedly retain the electrical contacts 30 in the housing 12. It should be appreciated that the power contacts 30 can alternatively include one or more engagement member constructed as desired, that is suitable system to retain the power contacts 30 in the housing 12.

Each mating end 44 includes a pair of mating end portions 44*a* and 44*b* that are spaced along the transverse direction T. Each mating end portion 44 includes at least one beam, such as three beams as illustrated. In particular, each mating end portion includes a first or central contact beam 50 that can be cantilevered so as to project from the contact body 31, and a pair of second and third outer contact beams 48 that can be cantilevered so as to project from the contact body 31 on opposing transverse sides of the central beam 50, or above and below the central beam in the orientation illustrated.

The central contact beam 50 flares outward in a first lateral direction away from the contact body 31 in a longitudinally forward direction along the beams 50. In particular, the contact beam 50 defines a contact mating surface 104 facing outward in a first lateral direction. The outer contact beams 48 flare outward in a second lateral direction away from the contact body 31 in longitudinally forward direction along the beams 48. In particular, the second contact beams 48 define respective contact mating surfaces 106 that face outward in the second lateral direction. The second lateral direction is opposite the first lateral direction. As illustrated, the beams 48 flare laterally toward the side wall 14, while the beams 50 flare laterally toward the side wall 16.

The beams 48 and 50 can define an equal and opposite angle with respect to the contact body 31 or longitudinal direction L, or can define opposite and different angles with respect to the contact body 31 or longitudinal direction L. In accordance with the illustrated embodiment, the beams 50, 48 define opposing angles of about 15 degrees with respect to the power contact body 31, though it should be appreciated that the beams 50 and 48 can define any angle as desired with respect to the contact body 31. When first and second adjacent contacts 30 of an associated pair of electrical contacts are positioned adjacent each other, the respective two beams 48 of each contact 30 extends in the same direction, and the beams 50 of each contact extends in the same direction. The contact beams 48 and 50 define respective laterally inwardly facing tips 103 and 105 that provide cam surfaces that assist in directing the contact beams 48 and 50 into corresponding receptacles of the receptacle connector 10A.

It should thus be appreciated that the mating ends 44*a* and 44*b* of each contact 30 are constructed substantially identically as illustrated, and that the mating ends 44 of the plurality of contacts 30 are also constructed substantially identically, though it should also be appreciated that the mating ends of each contact and of the plurality of contacts can alternatively be constructed differently if desired. Furthermore, while each mating end 44*a* and 44*b* is illustrated as including three contact beams 48 and 50, it should be appreciated that the connector 30 can include at least one contact beam, such as a pair of contact beams that extend in opposite directions from the contact body 31.

When power contacts 30 are inserted into or otherwise supported or retained by the housing 12, the mating ends 44 extend forward from the divider wall 17, and are located at the mating interface 82 of the electrical connector 10. The contact geometry at the mating ends 44 of the connectors 30 provides the ability to raise or lower the normal force of the contact beams 48 and 50 by merely lengthening or shortening the length of the beams. The contact geometry can thus mate with minimal force at the mating interface, which is beneficial when the contacts 30 are made from a low malleability material, such as a high performance copper alloy.

While the power contacts 30 can be constructed as a unitary member as illustrated in FIG. 6A, it should be appreciated that the power contacts 30 can alternatively be constructed as discrete sections. For instance, as illustrated in FIGS. 7A-B, the power contact 30 can include a pair of outer and inner contact sections 30*a* and 30*b*, such that the inner contact section 30*b* is nested within the outer contact section 30*a* so as to define the mating ends 44*a* and 44*b*.

Figure 7A:
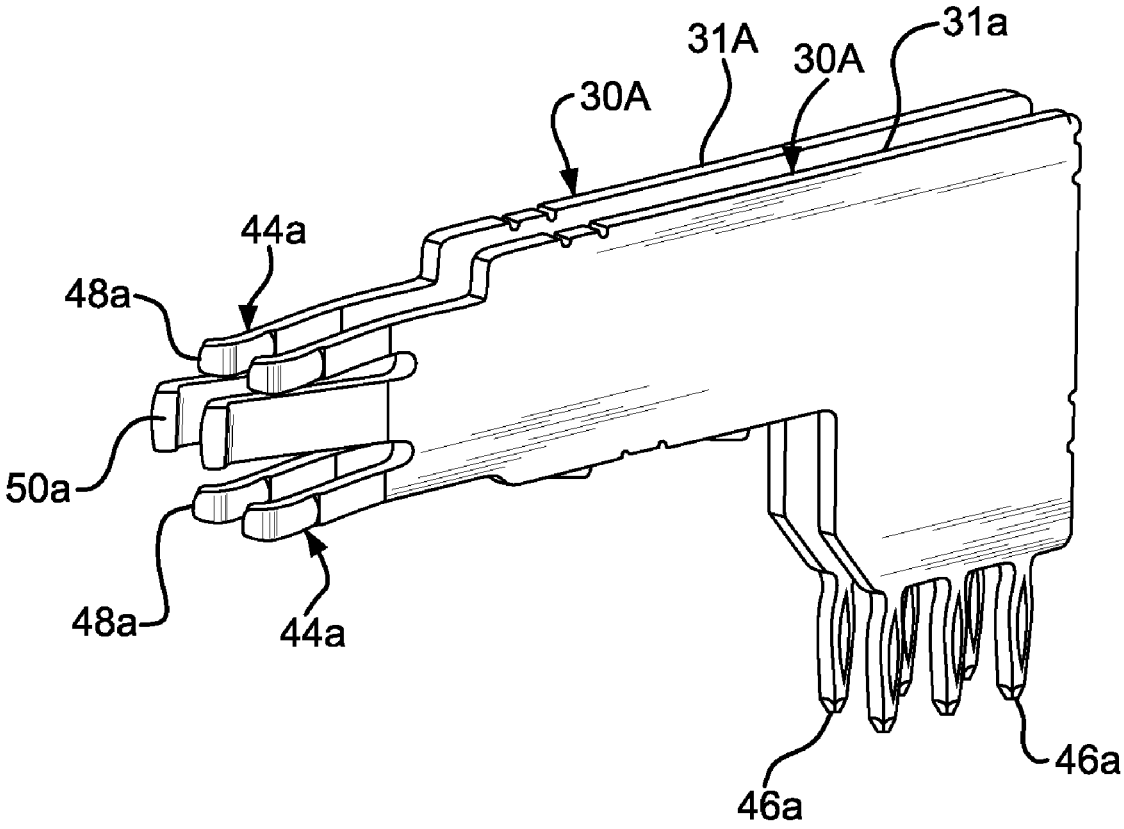
FIG. 7A is a perspective view of electrical power contacts of the electrical header connector illustrated in FIG. 2 in accordance with an alternative embodiment.

Referring to FIG. 7*a*, the outer power contact section 30*a* includes a contact body 31*a*, and one or more retention members are desired so as to secure the power contact section 30*a* to the connector housing 12. The outer power contact section 30*a* includes a mating end 44*a* that includes at least one beam, such as three beams as illustrated. In particular, each mating end portion includes a first or central contact beam 50*a* that can be cantilevered so as to project from the contact body 31*a*, and a pair of second and third outer contact beams 48*a* that can be cantilevered so as to project from the contact body 31*a* on opposing transverse sides of the central beam 50*a*, or above and below the central beam in the orientation illustrated. The contact beams 48*a* and 50*a* are constructed as described above with respect to the contact beams 48 and 50 of the mating end 44 of the electrical power contact 30, and thus flare out from the contact body 31*a* in the manner described above with respect to the contact beams 48 and 50 of the mating end 44 of the electrical power contact 30.

Figure 7B:
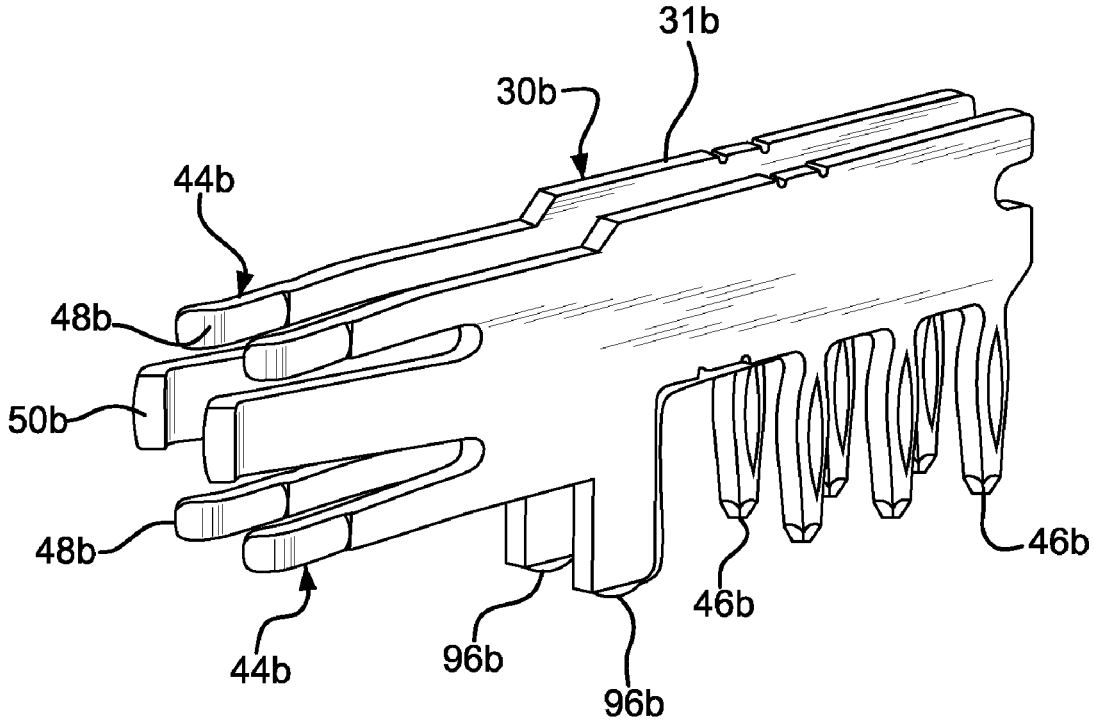
FIG. 7B is a perspective view of electrical power contacts configured to be nested with the electrical power contacts illustrated in FIG. 7A in accordance with an alternative embodiment.
Figure 8:
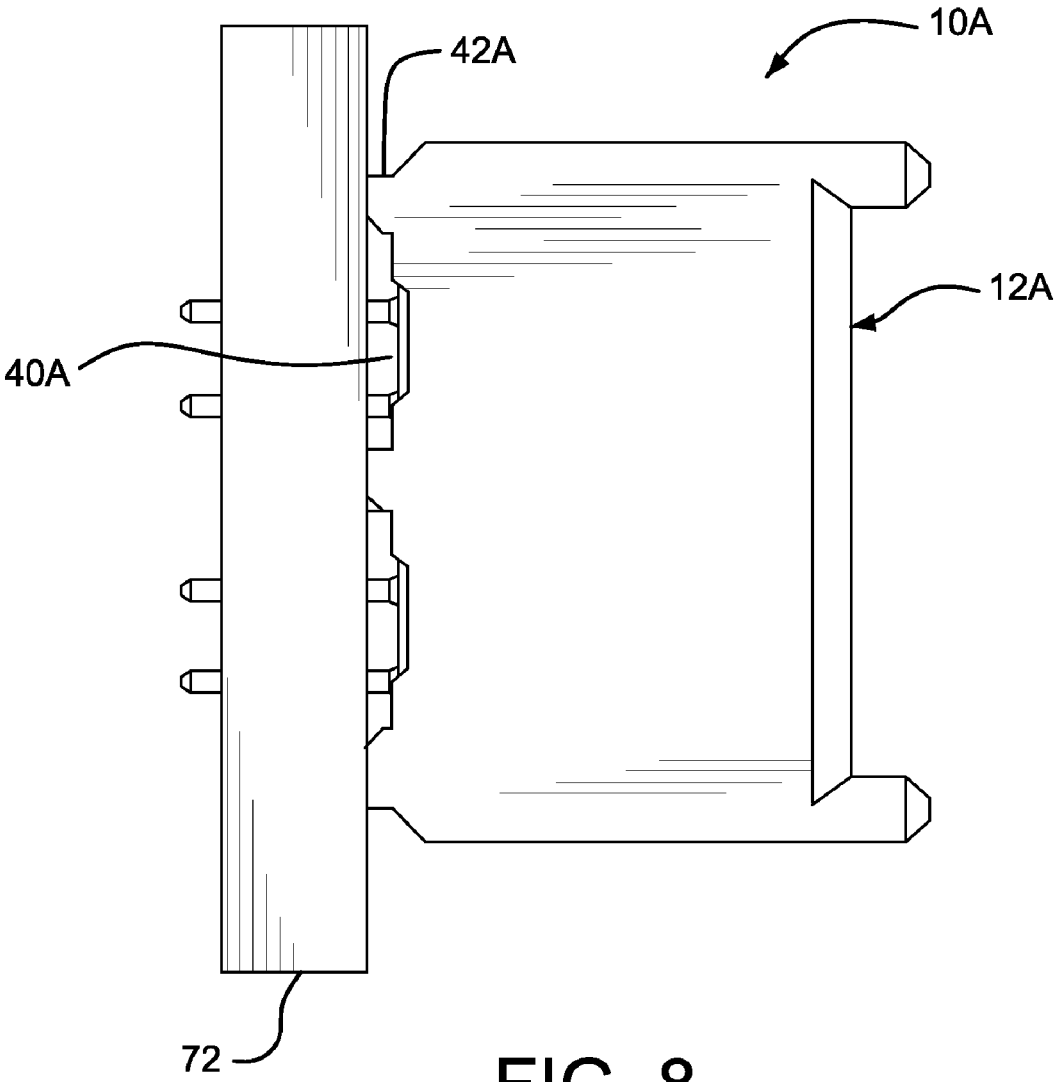
FIG. 8 is a side elevation view of the electrical receptacle connector illustrated in FIG. 1.

Referring to FIG. 7*b*, the inner power contact section 30*b* includes a contact body 31*b*, and one or more retention members, such as retention member 96*b*, so as to secure the power contact section 30*b* to the connector housing 12. The inner power contact section 30*b* includes a mating end 44*b* that includes at least one beam, such as three beams as illustrated. In particular, each mating end portion includes a first or central contact beam 50*b* can be is cantilevered so as to project from the contact body 31*b*, and a pair of second and third outer contact beams 48*b* that can be cantilevered so as to project from the contact body 31*b* on opposing transverse sides of the central beam 50*b*, or above and below the central beam in the orientation illustrated. The contact beams 48*b* and 50*b* are constructed as described above with respect to the contact beams 48 and 50 of the mating end 44 of the electrical power contact 30, and thus flare out from the contact body 31*b* in the manner described above with respect to the contact beams 48 and 50 of the mating end 44 of the electrical power contact 30.

The inner contact section 30*b* nests within (or below and forward with respect to) the outer contact section 30*a*, such that the mounting ends 46*a* and 46*b* can combine to provide the same mating end as the unitary contact 30 illustrated in FIG. 6. Likewise, when the inner contact section 30*b* is nested within the outer contact section 30*a*, the mating ends 44*a* and 44*b* can define the same spatial relationship as the mating ends 44*a* and 44*b* of the mating end 44 of the unitary contact 30 illustrated in FIG. 6.

Referring again to FIG. 4, the connector housing 12 includes at least one such as a first plurality of air passage slots 20 that extend longitudinally through the divider wall 17. Heat generated during operation can escape the connector via the air passage slots. At least one of the air passage slots 20 may extend below a bottom surface 22 of the substrate 70. As described above, the connector housing 12 further includes at least one such as a plurality of contact reception slots 18 that also extend longitudinally through the divider wall 17, and engage the electrical power contacts 30 when the power contacts are retained or supported by the housing 12.

One or both of the contact reception slots 18 and the air passage slots 20 can be in fluid communication with the heat dissipation slots 26 that extend transversely through the top wall 75. The housing 12 further includes one or more polarization members in the form of alignment grooves 84 located off-center at the top wall 75 and the bottom wall 77. The alignment grooves 84 correspond in cross-sectional shape to complementary polarization members in the form of alignment projections 88 of second electrical connector 10A (see FIG. 9), and thus ensure that the connectors 10 and 10A are mated in a desired orientation.

Referring now to FIGS. 8-11, the second receptacle power connector 10A includes a second insulative housing 12A that supports or retains a plurality of electrical contacts 54. The housing 12A includes a top wall 53 and a transversely opposed bottom wall 55, a front wall 57 and a longitudinally opposed rear wall 59 extending and connected between the top and bottom walls 53 and 55, and laterally opposed side walls 61 and 63. The connector housing 12A defines a mating interface 65 disposed proximate to the front wall 57, and a mounting interface 67 disposed proximate to the rear wall 59. Because the mating interface 65 is oriented substantially parallel to the mounting interface 67, the electrical connector 10A can be referred to as a vertical or mezzanine connector, though it should be appreciated that the electrical connector 10 could alternatively be constructed as a right-angle connector as desired, whereby the mating interface 65 extends substantially perpendicular to the mounting interface 67.

The mounting interface 67 is configured to interface with the electrical component or substrate 72. The mating interface 65 is configured to interface with the complementary header connector 10. In particular, the housing 12A defines at least one, such as a plurality of, receptacles 52 that extend longitudinally into or through the front wall 57 of the housing 12A. The electrical power contacts 54 are in operative communication with the receptacles 52, and in one embodiment are disposed in the receptacles, as described in more detail below. In accordance with the illustrated embodiment, the receptacles 52 are arranged in laterally extending rows, and in transversely extending columns. The receptacles 52 are elongate along the column direction with respect to the row direction. The rows and columns of receptacles are electrically insulated from each other by the housing 12A. As illustrated, the connector 10A includes two rows and three columns of receptacles 52, though it should be appreciated that the connector 10A can include any number of rows and columns of receptacles 52 as desired, including at least one.

Figure 12:
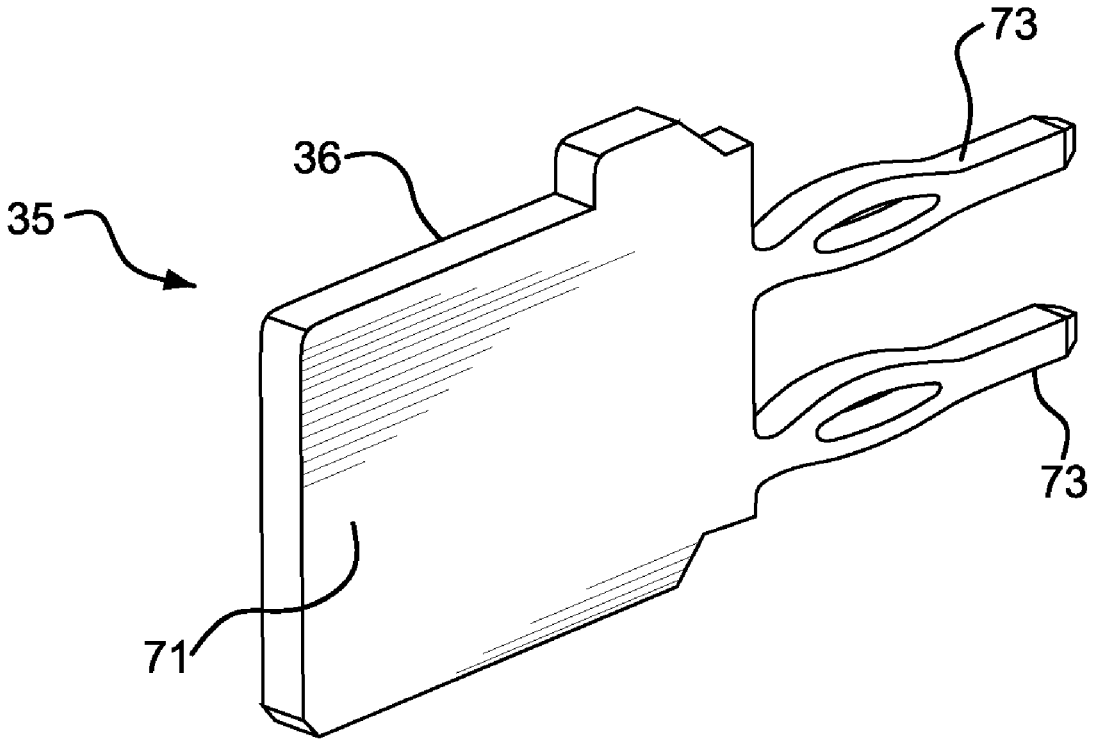
FIG. 12 is a perspective view of an electrical power contact of the electrical receptacle connector illustrated in FIG. 8.

Referring now to FIG. 12, the electrical connector 12A further includes a plurality of electrical power contacts 54 that include a contact body 36 that in turn defines a forward mating end 71 and an opposing rear mounting end 73. Because the mating end 71 is oriented substantially parallel to the mounting end 73, the electrical contact 54 can be referred to as a vertical or mezzanine contact, though it should be appreciated that the contact 54 could alternatively be constructed as a right-angle contact as desired, whereby the mating end 71 extends substantially perpendicular to the mounting end 73. The mounting ends 73 are illustrated as including a plurality of through-hole press-fit eye-of-the-needle contact tails, though it should be appreciated that the mounting ends 73 can alternatively be provided in alternative forms, including surface mounts, solder tails, and the like. The mating ends 71 are illustrated as plates or beams that can be integral and co-planar with the body 36 and mounting ends 73, though it should be appreciated that the mating ends 71 could alternatively be constructed as desired.

Referring now to FIGS. 8-12, the connector 10A includes a plurality of power contacts 54 that are operatively coupled to each receptacle 52. That is, a plurality of power contacts 54 and configured to mate with at least one complementary electrical power contact 30 of the complementary electrical connector 10 when the connectors 10 and 10A are mated. In accordance with the illustrated embodiment, the mating ends 71 of a plurality of power contacts are inserted or otherwise disposed into each of the receptacle slots 52. In particular, the three of the electrical contacts 54 are operatively coupled to each receptacle 52. The electrical contacts 54 are arranged as a first central or common electrical contact 54*a*, and second and third outer electrical contacts 54*b* and 54*c* disposed on opposed lateral sides from the first central electrical contact 54*a* and spaced from the first central electrical contact 54 such that a gap is disposed between the contacts 54*a* and 54*b*, and a gap is disposed between the contacts 54*a* and 54*c*. The three of the electrical contacts 54 can be three consecutive ones of the plurality of electrical of power contacts 54. The three consecutive ones 54*b*, 54*a*, 54*c* of the plurality of electrical contacts 54 define only two chambers 130*a*, 130*b* that each receive a respective mating power contact.

Thus, the outer contacts 54*b* and 54*c* at least partially define respective first and second chambers 130*a* and 130*b* in combination with the central contact 54*a*, such that the central contact 54*a* divides the first and second chambers 130*a* and 130*b*. Otherwise stated, each receptacle 52 defines at least a pair of two adjacent chambers 130*a* and 130*b* that are defined by a common electrically conductive contact or wall that is positioned between two electrically conductive contacts or walls. The two electrically conductive contacts or walls are spaced apart from one another and spaced apart from the common electrically conductive contact or wall. In this regard, the central contact 54*a* can be referred to as a common electrical contact or wall, as it is common to both chambers 130*a* and 130*b*, and is configured to mate with more than one, such as a pair of, complementary electrical power contacts 30 of the complementary power connector 10. The outer contacts 54*b* and 54*c* can be referred to as the two electrically conductive contacts or walls that are spaced from one another and spaced apart from the common electrically conductive contact or wall 54*a*. Thus, the central contact 54*a* defines a first chamber-facing or first electrical contact surface 79*a* that faces the chamber 130*a*, and an opposed chamber-facing or second electrical contact surface 79*b* that faces the chamber 130*b*. At least one of the contacts, such as the outer contacts 54*b* and 54*c*, can include a bulbous region 81 at the respective mating end 71 that projects into the associated chamber so as to assist in mating with the complementary electrical contacts 30. The outer contact 54*c* may also define a third electrical contact surface 79*c*.

In one embodiment, the first electrical contact surface 79*a*, the second electrical contact surface 79*b*, and the third electrical contact surface 79*c* can form three consecutive electrical contact surfaces 79*a*, 79*b*, 79*c* supported by a housing. Two consecutive ones 79*a*, 79*b* of the three consecutive electrical contact surfaces 79*a*, 79*b*, 79*c* are configured to receive two different mating portions of a first mating electrical power contact and a third one 79*c* of the three consecutive electrical contact surfaces 79*a*, 79*b*, 79*c* is configured to receive a mating portion of a second mating electrical power contact. The mating portions can be in the form of contact beams 48 and 50 as described above, or any alternatively constructed mating surface.

The electrical contacts 54 are configured such that the mating end 71 of a given contact 54 is operatively coupled to vertically aligned (or aligned along the transverse direction T) receptacles 52. In accordance with the illustrated embodiment, the contacts 54 define a contact beam of more than one receptacle 52. For instance, the contact 54 that defines the outer contact 54*b* at least partially defines transversely aligned chambers 130*a* along the column direction, while the contact that defines the outer contact 54*c* at least partially defines transversely aligned chambers 130*b* along the column direction, while the contact 54 that defines the central contact 54*a* at least partially defines both transversely aligned chambers 130*a* and 130*b* along the column direction. It should be appreciated, however, that one contact 54 can alternatively be operatively coupled to one of the transversely aligned receptacles 52, while another contact is operatively coupled to the other transversely aligned receptacle 52.

Figure 13A:
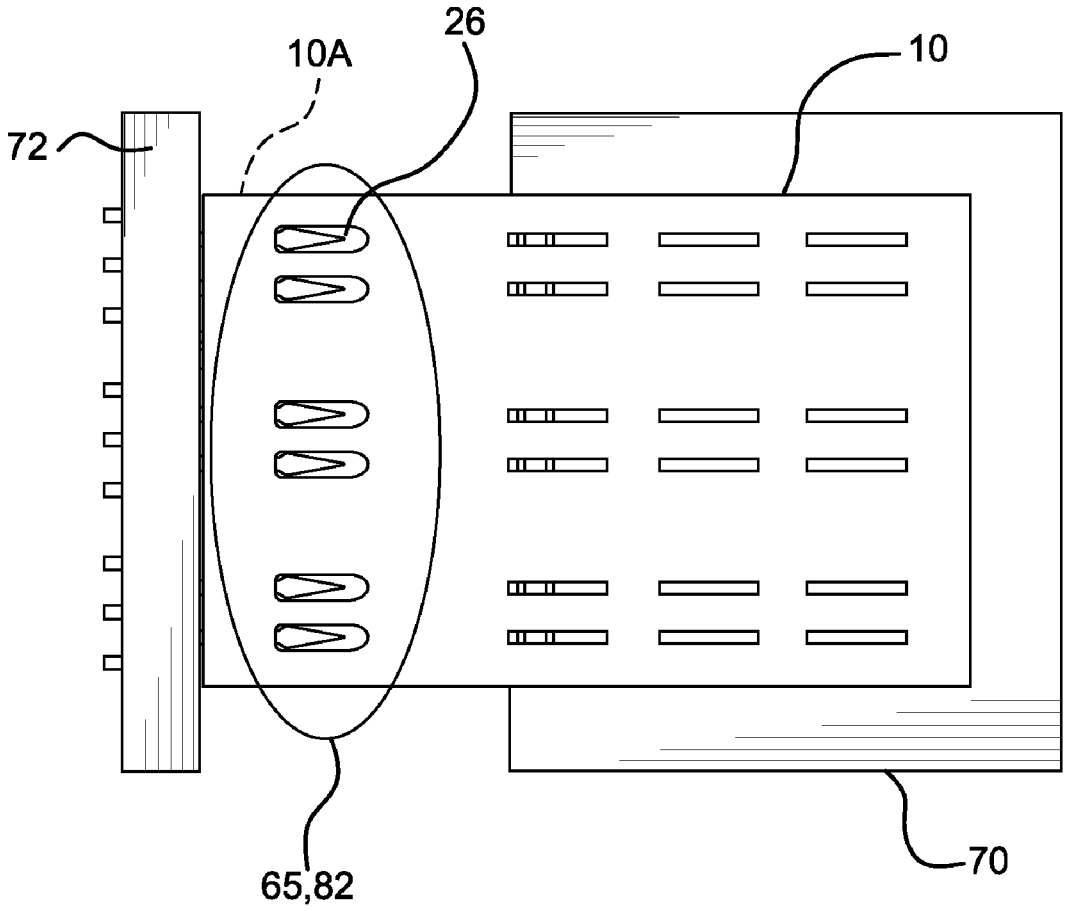
FIG. 13A is a top plan view of the electrical connector system illustrated in FIG. 1, showing the electrical header connector mated with the electrical receptacle connector.
Figure 13B:
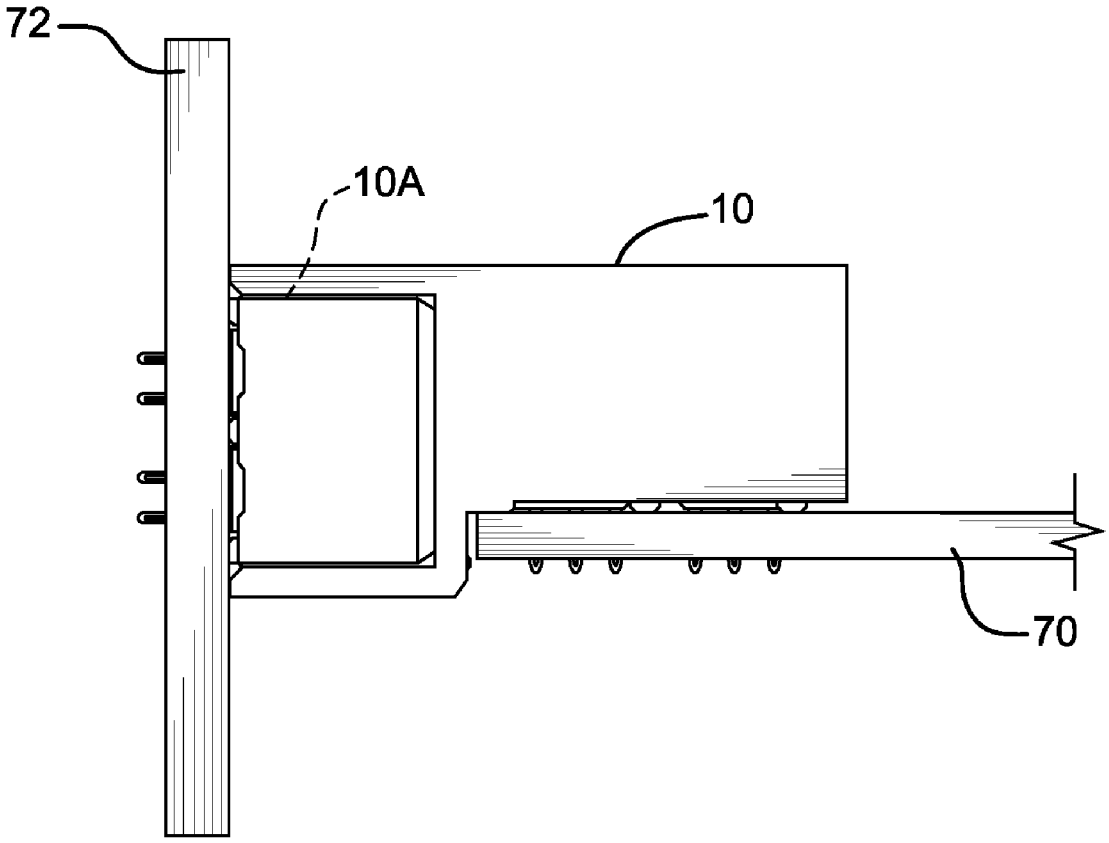
FIG. 13B is a side view of the electrical connector system illustrated in FIG. 13A.

Referring also to FIGS. 13A-B, during operation, as the electrical connectors 10 and 10A are mated, the respective pairs of electrical contacts 30 of the header connector 10 are aligned with the complementary receptacles 52 of the receptacle connector 10A. In particular, each contact 30 of a given pair of electrical contacts 30 is aligned with a corresponding chamber 130*a* and 130*b*, respectively, of a select receptacle 52. As a result, when the connectors 10 and 10A are mated, one of the contacts 30 of a given pair of contacts is inserted into one chamber 130*a* and the other contact 30 of the pair of contacts is inserted into the other chamber 130*b*.

The contact 30 that is disposed in the first chamber 130*a* contacts, or mates with, and is thus electrically connected with, the central power contact 54*a* and the outer power contact 54*b* that at least partially defines the first chamber 130*a*. In particular, the second and third outer contact beams 48 of the electrical power contact 40 mate with the outer power contact 54*b* of the receptacle connector 10A, and the central contact beam 50 mates with the central contact 54*a* of the receptacle connector 10A. The other electrical power contact 30 of the pair of contacts of the header connector 10 contacts, or mates with, and is thus electrically connected with, the central power contact 54*a* and the outer power contact 54*c* that at least partially define the first chamber 130*b*. In particular, the second and third outer contact beams 48 of the electrical power contact 30 mate with the central power contact 54*a* of the receptacle connector 10A, and the outer contact beams 48 mate with the outer power contact 54*c*. The contact beams 50 are deflected slightly inward and the contact beams 48 are also deflected slightly inward in the opposite direction relative to the contact beams 50. Thus, the mating connector contact section 44 makes electrical contact on two inwardly facing sides with the pairs of power contacts in the mating power connector 10A.

In this regard, it is appreciated that the contact beams 48 and 50 of each contact 30 of an associated pair of adjacent contacts extend in the same direction, though it should be appreciated that the contact beams 48 of one contact 30 of an associated pair of contacts can extend in an opposite direction with respect to the contact beams 48 of the other contact of the associated pair of contacts. Likewise, the contact beams 50 of one contact 30 of an associated pair of contacts can extend in an opposite direction with respect to the contact beams 50 of the other contact of the associated pair of contacts. It can be said that each contact includes at least a first portion that mates with one of the outer contacts 54*b* or 54*c*, and a second portion that mates with the central contact 54*a*. Thus, the second portion of each contact 30 of each of an associated pair of contacts mates with the central contact 54*a* of the receptacle connector.

Otherwise stated, the central beam 54*a* is configured to electrically couple to both of the first and second electrical power contacts 30 of the first electrical connector 10 when the first electrical connector 10 is mated with the second electrical connector 10A. The outer power contacts 54*b* and 54*c* can be referred to as dedicated power contacts because they mate with a dedicated one of an associated pair of the contacts 30. The central power contact 54*a* can be referred to as a shared or common power contact because it mates with both contacts of an associated pair of contacts 30. The central power contact thus electrically connects the chambers 130*a* and 130*b* of a given receptacle 52.

FIGS. 13A and 13B show the first electrical connector 10 mated with the second electrical connector 10A. When the first electrical connector mates with the second electrical connector 10A, the mating ends 44 of at least two adjacent electrical contacts 30 on the electrical connector 10 physically touch a common one of the three spaced apart power contacts 54*a-c* of the second electrical connector 10A. Stated another way, the beam 50 of one of the electrical contacts 30 of beam 48 of an adjacent one of the electrical contacts 30 each touch a common one of the second plurality of electrical contacts 54. The contact beam 48 of the one of the electrical contacts 30 and the contact beam 50 of an adjacent one of the electrical contacts 30 of an associated pair of contacts each touch dedicated ones of the second plurality of electrical contacts 54.

Referring again to FIGS. 8-11, the housing 12A includes at least one, such as a plurality of, heat dissipation cutouts 40A that project into the mounting interface 67, and standoffs 42A that project outwardly from the mounting interface 67. The cutouts 40A and standoffs 42A allow heat generated during operation at the mounting interface 67 to escape the housing 12A. The housing 12A further includes polarization members in the form of alignment projections 88 that are positioned so as to engage the alignment grooves 84 of the header connector 10, thereby ensuring that the connectors 10 and 10A can only be mated in a desired relative orientation. It should be appreciated that the polarization members of the connectors 10 and 10A can be alternatively constructed as desired. For instance, the polarization members of the header connector 10 can be provided as projections, while the polarization members of the receptacle connector 10A can be provided as grooves.

The receptacle connector 12A further includes a plurality of heat dissipation slots 56 that extend through the insulative housing 12A. In particular, the heat dissipation slots 56 extend transversely through the top wall 53 and the bottom wall 55, at a location aligned with the chambers 130 and 130*b*. The heat dissipation slots 26 disposed at the rear section 78 of the header housing 12 are aligned with the contact bodies 31, while the heat dissipation slots 26 disposed at the front section 80 of the header housing 12 are aligned with the mating ends 44 of the header contacts 30. Likewise, the heat dissipation slots 34 extending through the bottom wall 77 of the header housing 12 are aligned with the mating ends 44 of the header contacts 30. Accordingly, when the connectors 10 and 10A are mated, such that the mating interface 82 of the header housing 12 receives the mating interface 65 of the receptacle housing 12A, the slots 56 are at least partially aligned with, and thus overlap, the heat dissipation slots 26 and 34, such that heat can freely dissipate from the mating ends of the contacts 30 and 54 out the slots 26, 34, and 56. It should thus be appreciated that the electrical connector system 68 reduces complexity, space, and cost as compared to prior approaches while still achieving a desired power output (such as 30 amps) of power throughput within temperature constraints The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

The invention claimed is:

1. An electrical power connector system comprising:

a first electrical connector including a connector housing that supports a first electrical power contact and a second electrical power contact that is disposed adjacent the first electrical power contact;

a second electrical connector including a connector housing that defines a plurality of receptacles, and further including a plurality of electrical contacts supported by the connector housing, such that a common electrical contact of one of the plurality of electrical contacts is operatively associated with at least a select one of the plurality of receptacles, wherein the common electrical contact electrically couples to both of the first and second electrical power contacts of the first electrical connector when the first electrical connector is mated with the second electrical connector, a first dedicated electrical contact of the plurality of electrical contacts and a second dedicated electrical contact of the plurality of electrical contacts, wherein the first and second dedicated electrical contacts are disposed on opposite sides of the common electrical contact, such that the first dedicated electrical contact and the common electrical contact are both configured to connect to the first electrical power contact, and the second dedicated electrical contact and the common electrical contact are both configured to connect to the second electrical power contact, wherein the first and second power contacts each include a plurality of angularly offset contact beams, wherein at least one of the angularly offset contact beams of the first and second power contacts is configured to contact the common electrical contact, and at least another of the angularly offset contact beams of the first and second power contacts is configured to contact the associated first or second dedicated electrical contacts.

2. The electrical power connector system as recited in claim 1, wherein the first electrical power contact and the second electrical power contact are spaced from each other along a lateral direction, and the first electrical power contact defines a first central cantilevered contact beam and a pair of first outer cantilevered contact beams disposed on opposite sides of the first central cantilevered contact beam along a direction that is substantially perpendicular to the lateral direction.

3. The electrical power connector system as recited in claim 2, wherein the first central cantilevered contact beam flares outward in a first lateral direction, and the first outer cantilevered contact beams flare outward in a second lateral direction that is opposite the first lateral direction.

4. The electrical power connector system as recited in claim 2, wherein the second electrical power defines a second central cantilevered contact beam and a pair of second outer cantilevered contact beams disposed on opposite sides of the second central cantilevered contact beam along a direction that is substantially perpendicular to the lateral direction.

5. The electrical power connector system as recited in claim 4, wherein the second central cantilevered contact beam flares outward in a first lateral direction, and the second outer cantilevered contact beams flare outward in a second lateral direction that is opposite the first lateral direction.

6. The electrical power connector system as recited in claim 4, wherein the first central cantilevered contact beam and the second outer cantilevered contact beams couples to the common electrical contact when the first electrical connector is mated with the second electrical connector.

7. The electrical power connector system as recited in claim 6, wherein the first outer cantilevered contact beams couple to the first dedicated electrical contact when the first electrical connector is mated with the second electrical connector.

8. The electrical power connector system as recited in claim 7, wherein the second central cantilevered contact beam couples to the second dedicated electrical contact when the first electrical connector is mated with the second electrical connector.

9. The electrical power connector system as recited in claim 1, wherein the central contact beam is parallel to the first and second dedicated electrical contacts.

10. The electrical power connector system as recited in claim 9, wherein the central contact beam, the first dedicated electrical contact, and the second dedicated electrical contact are straight.

11. The electrical power connector system as recited in claim 9, wherein the a first and second dedicated electrical contacts are disposed on opposite sides of the common electrical contact along a row direction, the first and second electrical connectors mate along a mating direction that is perpendicular to the row direction, and the central contact beam, the first dedicated electrical contact, and the second dedicated electrical contact are straight along a column direction that is perpendicular to the both the row direction and the mating direction.

12. The electrical power connector system as recited in claim 1, wherein the first and second electrical power contacts are right-angle contacts.

13. The electrical power connector system as recited in claim 12, wherein the electrical contacts of the second electrical connector are vertical contacts.

14. An electrical receptacle power connector configured to mate with a header connector of the type having a header connector housing, and first and second adjacent header contacts that are supported by the housing, each of the first and second adjacent header contacts defining at least a pair of first and second contact beams, the electrical power receptacle connector comprising:

a housing supporting a plurality of electrical contacts that are spaced apart along a row direction, the housing defining at least a pair of receptacles spaced along a column direction that is orthogonal to the row direction, such that the electrical contacts include a central electrical contact in each of the pair of receptacles, and first and second outer electrical contacts disposed on opposite sides of the central electrical contact in each of the pair of receptacles, such that 1) the first outer electrical contact and the central electrical contact of each receptacle define a first chamber in each receptacle configured to receive respective ones of the first and second contact beams of the first header contact so as to electrically connect to the respective ones of the first and second contact beams of the first header contact, and 2) the second outer electrical contact and the central electrical contact of each receptacle define a second chamber in each receptacle configured to receive respective ones of the first and second contact beams of the second header contact so as to electrically connect to the respective ones of the first and second contact beams of the second header contact.

15. The electrical receptacle power connector as recited in claim 14, wherein the housing defines a third receptacle that is spaced from and aligned with one of the pair of receptacles along the row direction, and the electrical contacts further include a central electrical contact in the third receptacle, and first and second outer electrical contacts disposed on opposite sides of the central electrical contact in the third receptacle, such that 1) the first outer electrical contact and the central electrical contact of the third receptacle define a first chamber in the third receptacle configured, and 2) the second outer electrical contact and the central electrical contact of the third receptacle define a second chamber in the third receptacle.

16. The electrical receptacle power connector as recited in claim 15, wherein the central, first outer, and second outer contacts are all oriented parallel to each other.

17. The electrical receptacle power connector as recited in claim 15, wherein the central, first outer, and second outer contacts are all straight.

18. The electrical receptacle power connector as recited in claim 15, wherein the central, first outer, and second outer contacts are all straight along the column direction.

19. The electrical receptacle power connector as recited in claim 14, wherein a central, first outer, and second outer electrical contacts are all vertical contacts.

* * * * *